United States Patent [19]

Lindsten et al.

[11] Patent Number: 4,938,886

[45] Date of Patent: Jul. 3, 1990

[54] SUPERPARAMAGNETIC LIQUIDS AND METHODS OF MAKING SUPERPARAMAGNETIC LIQUIDS

[75] Inventors: Göran R. Lindsten, Mölndal, Sweden; John E. Wyman, Westford, Mass.

[73] Assignee: SKF Nova AB, Gothenburg, Sweden

[21] Appl. No.: 247,481

[22] Filed: Sep. 21, 1988

[30] Foreign Application Priority Data

Feb. 8, 1988 [SE] Sweden ..... 8800394-2

[51] Int. Cl.[5] ..... H01F 1/28

[52] U.S. Cl. ..... 252/62.51

[58] Field of Search ..... 252/62.51 R, 62.52; 106/460

[56] References Cited

U.S. PATENT DOCUMENTS

| | | | |
|---|---|---|---|
| 3,215,572 | 11/1965 | Papell | 149/2 |
| 3,387,993 | 6/1968 | Flowers | 117/121 |
| 3,531,413 | 9/1970 | Rosenweig | 252/62.52 |
| 3,700,595 | 10/1972 | Kaiser | 252/62.56 |
| 3,764,540 | 10/1973 | Khalafalla et al. | 252/62.52 |
| 3,843,540 | 10/1974 | Reimers et al. | 252/62.52 |
| 3,917,538 | 11/1975 | Rosenweig | 252/62.52 |
| 4,094,804 | 6/1978 | Shimolizaka | 252/62.52 |
| 4,208,294 | 6/1980 | Khalafalla et al. | 252/62.52 |
| 4,253,886 | 3/1981 | Aonuma et al. | 252/62.51 |
| 4,285,801 | 8/1981 | Chiang | 252/62.51 |
| 4,315,827 | 2/1982 | Bottenberg et al. | 252/62.52 |
| 4,322,474 | 3/1982 | Matsuura et al. | 252/62.54 |
| 4,333,988 | 6/1982 | Yamada et al. | 252/62.54 |
| 4,430,239 | 2/1984 | Wyman | 252/62.52 |
| 4,485,024 | 11/1984 | Furumura et al. | 252/62.51 |
| 4,554,220 | 11/1985 | Yamamoto et al. | 252/62.51 |
| 4,604,222 | 8/1986 | Borduz et al. | 252/62.52 |
| 4,608,186 | 8/1986 | Wakayama et al. | 252/62.52 |
| 4,626,370 | 12/1986 | Wakayama et al. | 252/62.52 |
| 4,701,276 | 10/1987 | Wyman | 252/62.52 |
| 4,741,850 | 5/1988 | Wyman | 252/62.52 |
| 4,867,910 | 9/1989 | Meguro et al. | 252/519 |

FOREIGN PATENT DOCUMENTS

| | | |
|---|---|---|
| 0129328 | 12/1984 | European Pat. Off. . |
| 0208391 | 1/1987 | European Pat. Off. . |
| 2659171 | 7/1977 | Fed. Rep. of Germany . |
| 3032061 | 6/1982 | Fed. Rep. of Germany . |
| 3312565 | 10/1983 | Fed. Rep. of Germany . |
| 3439117 | 5/1985 | Fed. Rep. of Germany . |

OTHER PUBLICATIONS

"The Conformational Consequences of Replacing Methylene Groups by Ether Oxygen", Johannes Dale, Tetrahedron, 30:1683–1694.

*Primary Examiner*—Jeffrey E. Russel
*Assistant Examiner*—Stephen G. Kalinchak
*Attorney, Agent, or Firm*—Burns, Doane, Swecker & Mathis

[57] ABSTRACT

Superparamagnetic liquids comprising:

(A) magnetic particles in stable colloidal suspension; (B) an A-X-B dispersant wherein A is derived from a non-ionic surface active agent, B is a carboxylic acid group and X is a connecting group between A and B; and (C) a carrier liquid which is a thermodynamically good solvent for A but which does not form a stable superparamagnetic liquid with magnetic particles coated only with oleic acid.

28 Claims, 1 Drawing Sheet

SUPERPARAMAGNETIC LIQUIDS AND METHODS OF MAKING SUPERPARAMAGNETIC LIQUIDS

BACKGROUND OF THE INVENTION

The present invention relates to superparamagnetic liquids having desirably low viscosity and low corrosivity.

Superparamagnetic liquids, sometimes referred to as "ferrofluids" or magnetic colloids, are colloidal dispersions or suspensions of sub domain sized magnetic particles in a carrier liquid. The magnetic particles are maintained in stable colloidal suspension by one or more dispersing agents.

Superparamagnetic liquids can be positioned and held in space, without a container, by a magnetic field. This unique property has led to their use as liquid seals having very low drag torque and which do not generate particles during dynamic operation as conventional lip seals may do. Liquid seals using superparamagnetic liquid have found wide use as exclusion seals for computer disc drives and as pressure seals in devices with a multiplicity of liquid seals, or stages. Superparamagnetic liquids are also used as heat transfer fluids between voice coils and magnets of loudspeakers. Certain superparamagnetic liquids and their compositions are described in U.S. Pat. Nos. 3,700,595, 3,764,540, 3,843,540, 3,917,538, 4,208,294, 4,285,801, 4,315,827, 4,333,988 and 4,701,276.

The dispersant is a critical component in magnetic fluids which remain stable suspensions in the presence of a magnetic field yet which have desirable viscosity characteristics. Fatty acids, such as oleic acid, have been used as dispersing agents to stabilize magnetic particle suspensions in some low molecular weight non-polar hydrocarbon liquids such as kerosene. Use of fatty acids, however, has not proven satisfactory for dispersing magnetic particles in polar organic carrier liquids or hydrocarbon oils which are high molecular weight non-polar carrier liquids.

Viscosity is an important characteristic of superparamagnetic liquids. In many dynamic applications such as in exclusion seals, the viscosity of the superparamagnetic liquid corresponds to the friction of the seal. The higher the viscosity, the greater the energy loss, the higher the temperature of the superparamagnetic liquid in the dynamic mode. Moreover, the higher the temperature of the superparamagnetic liquid the higher the evaporation rate of the carrier liquid and the shorter will be the operating life of the device. U.S. Pat. No. 4,430,239 describes superparamagnetic liquids with low viscosity, high solids content and good magnetization which use acid phosphoric acid esters as dispersants for the magnetite particles. According to U.S. Pat. No. 4,430,239, the use of strong phosphoric acid-type surfactants as dispersing agents, particularly use of an excess of the usual or normal dispersing amount needed to disperse the magnetic particles, materially reduces the viscosity of the "ferrofluid". The excess amount of acid phosphoric acid ester used in U.S. Pat. No. 4,430,239 is about 10 percent by weight more than the usual or normal dispersing amount of the dispersing agent and, more preferably, 30–60% by weight more than the usual or normal dispersing amount.

Acid phosphoric acid ester dispersing agents described in U.S. Pat. No. 4,430,239, however, tend to lower the viscosity of the "ferrofluid", in part, by dissolving the smaller magnetite particles in the "ferrofluid". This is shown by a shift of the particle size distribution from log-normal distribution toward a Gaussian distribution when acid phosphoric acid ester dispersants are used. The corrosive character of acid phosphoric acid ester dispersing agents is apparently responsible for dissolving small magnetic particles. An excess of strong acid-type dispersant also tends to dissolve and corrode metallic components of systems with which these "ferrofluids" are used. In addition, it is known that acid phosphoric acid esters of aliphatic alcohols undergo thermal decomposition at temperatures above about 100° C. and form acid phosphoric acid as one of the decomposition products. The thermal decomposition of an phosphoric acid ester is illustrated by the following equation:

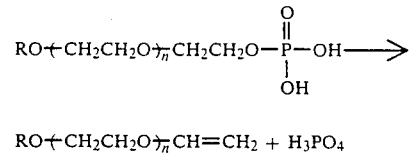

$$RO\text{-}(CH_2CH_2O)_n\text{-}CH_2CH_2O\text{-}\underset{\underset{OH}{|}}{\overset{\overset{O}{\|}}{P}}\text{-}OH \longrightarrow RO\text{-}(CH_2CH_2O)_n\text{-}CH{=}CH_2 + H_3PO_4$$

Phosphoric acid, of course, is a stronger acid than the acid phosphoric acid ester and it also tends to corrode metallic components of systems in which the "ferrofluids" are used and to dissolve some of the finely divided magnetite in suspension thereby lowering the saturation magnetization value of the "ferrofluid". The magnetization value of the superparamagnetic liquid, of course, is a measure of the quantity of magnetic particles in the superparamagnetic liquid stabilized by the dispersant. Therefore, although use of acid phosphoric acid ester dispersants provides "ferrofluids" with desirably low viscosity, the corrosive character of the dispersant itself and the byproduct of its thermal decomposition, creates drawbacks to the use of "ferrofluids" using acid phosphate acid ester dispersants. In accordance with the present invention, stable, superparamagnetic liquids with desirably low viscosity are provided using dispersants for the magnetic particles which are substantially less acidic and less corrosive than those used in the superparamagnetic liquids described in U.S. Pat. No. 4,430,239.

A further problem with magnetic fluids using acid phosphoric acid esters of long chain alcohols is the oxidative degradation of the dispersant when the magnetic fluids are heated in air. Oxidative degradation of the dispersant, in addition to its thermal decomposition, results in gellation of the magnetic colloid more rapidly than would occur in the absence of oxidative degradation. Practice of the present invention can provide magnetic colloids having diminished oxidative degradation relative to magnetic colloids using acid phosphoric acid esters of long chain alcohols as the dispersant.

SUMMARY OF THE INVENTION

Figure 1:
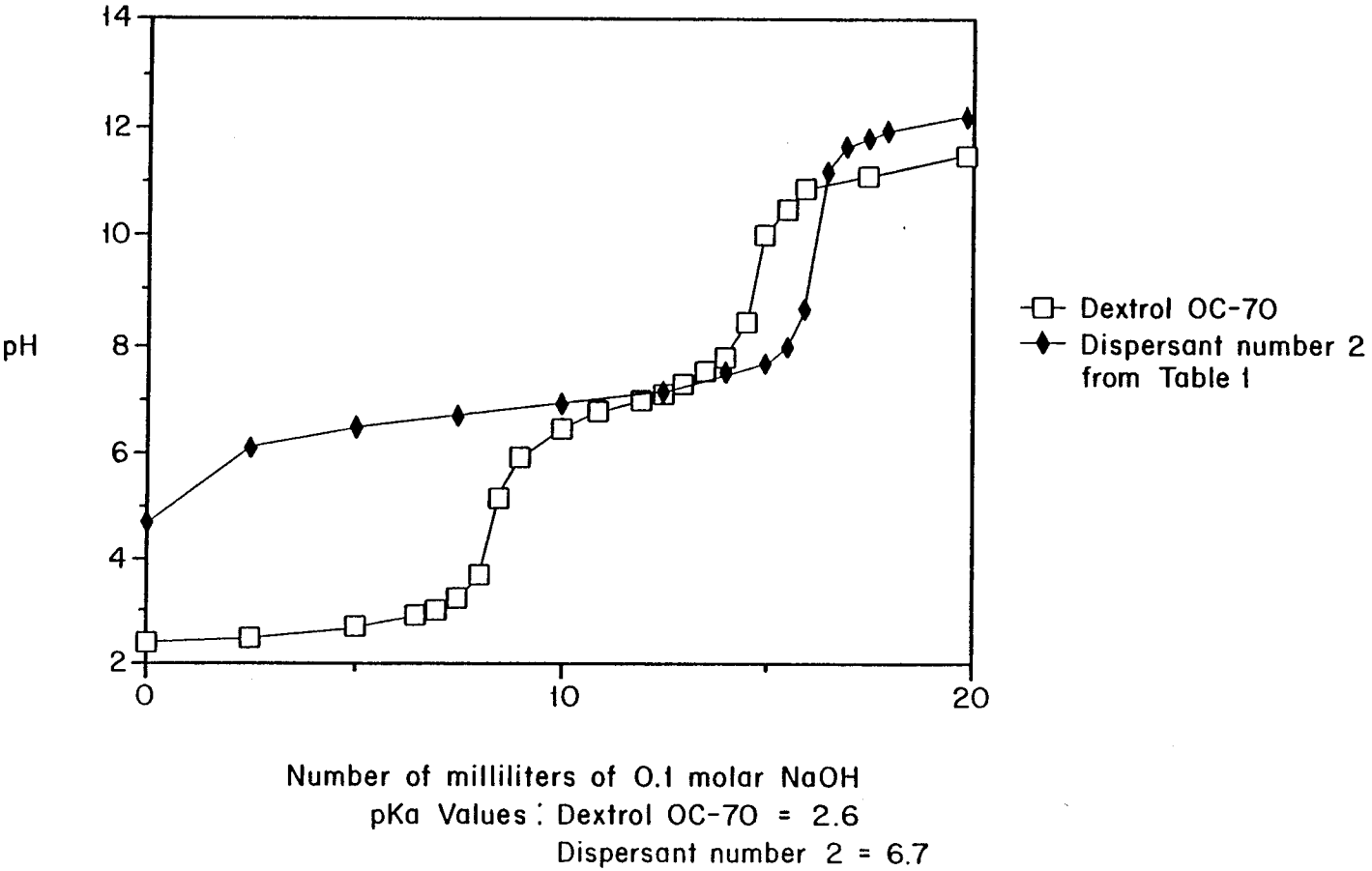
FIG. 1 is a graph comparing the pH values for Dextrol OC-70, an acid phosphoric acid ester dispersant, with a dispersant of the present invention, dispersant No. 2 from Table 1, as the two dispersants are titrated with sodium hydroxide. The pKa values are calculated from this graph.

One embodiment of the present invention is a superparamagnetic liquid comprising: (A) magnetic particles in stable colloidal suspension; (B) a dispersing agent of the formula A-X-B anchored to the magnetic particles, wherein A is derived from a non-ionic surface active agent, B is an organic carboxylic acid group which anchors said dispersing agent to said magnetic particles, and X is a connecting group linking A to B wherein X comprises at least one carbon atom; and (C) a carrier liquid which is a thermodynamically good solvent for A, but which does not form a stable superparamagnetic liquid with magnetic particles coated only with oleic acid.

Additional advantages and embodiments of the invention will be set forth in part in the description which follows, and in part will be apparent from the description, or may be learned by practice of the invention. The advantages of the invention may be realized and attained by processes, materials and combinations particularly pointed out in the appended claims.

DETAILED DESCRIPTION OF THE INVENTION

Any magnetic material may be used as the magnetic particle of the present invention but those most commonly used are 1) ferrites such as magnetite, zinc ferrite or manganese ferrite; 2) metals such as iron, nickel or cobalt; and 3) chromium dioxide. Particles useful in the present invention are subdomain in size, ordinarily from about 20 Angstroms to about 400 Angstroms in diameter, preferably from about 50 to about 200 Angstroms in diameter. Magnetite, the most commonly used magnetic material, is ordinarily precipitated from water according to the following chemical reaction, $$FeSO_4+2FeCl_3+8NH_4OH \rightarrow Fe_3O_4+(NH_4)_2SO_4+4H_2O+6NH_4Cl$$

Those of ordinary skill in the art are thoroughly familiar with procedures for making magnetite and other materials useful as magnetic particles.

Dispersants of the present invention are A-X-B dispersants wherein A is derived from a non-ionic surface active agent, B is an organic carboxylic acid group which anchors the dispersing agent to the magnetic particles, and X is a connecting group linking A to B wherein X comprises at least one carbon atom. A may be referred to herein as the oil soluble group, B as the anchor group, and X as a connecting group between A and B. Use of A-X-B dispersants of the present invention provides stable superparamagnetic liquids in polar organic carrier liquids and high molecular weight nonpolar carrier liquids, with desirably low viscosity without corrosive characteristics attendant "ferrofluids" which use more highly acidic dispersing agents.

Selection of a carboxyl group as the anchor group in the present invention provides a weaker acid than the acid phosphoric acid esters utilized as dispersants for the superparamagnetic liquids described in U.S. Pat. No. 4,430,239. The weaker acidity of the carboxylic acid group is illustrated in FIG. 1 which compares the titration curves for Dextrol OC-70, an acid phosphoric acid ester dispersant described in U.S. Pat. No. 4,430,239, with a succinic acid half ester dispersant of the present invention (dispersant No. 2 in Table 1) produced by condensation of succinic anhydride and "DeSonic 6T" (an ethoxylated alcohol produced by DeSoto Inc.). The calculated pKa values are shown in FIG. 1. The smaller the pKa value for the dispersant, of course, the stronger its acidic character.

Design of the oil soluble group of the dispersant that is best matched to the carrier liquid is an important feature of the present invention requiring consideration of a variety of factors including the solubility characteristics of the carrier liquid, the desired viscosity of the product superparamagnetic liquid, the stability required and the degree of magnetization required.

The oil soluble group A of the present invention is derived from a non-ionic surface active agent and is selected to be compatible with and dissolved by a specific carrier oil. Non-ionic surface active agents from which A is derived include ethoxylated alcohols, ethoxylated alkyl phenols, ethoxylated fatty acids, ethoxylated amides, ethoxylated amines and ethylene oxide/propylene oxide block polymers. Examples of commercially available non-ionic precursors to the oil soluble A group include, but are not limited to, poly(ethoxylated) alcohols such as "DeSonic 6T" (produced by DeSoto Inc.), poly(ethoxylated) fatty acids such as "Mulgofen VN-430" (produced by GAF Corp.), ethoxylated and poly(ethoxylated) amides such as "Ethomid 0/15" (produced by Akzo Chemie BV), ethoxylated and poly(ethoxylated) alkylated phenols such as "Antarox CA-210" and "DM-430" (produced by GAF Corp.). The products of reacting alcohols with a mixture of propylene oxide and ethylene oxide such as "Tergitol Min-Foam 1X" and "Tergitol Min-Foam 2X" (produced by Union Carbide Corp.) are also precursors to the oil soluble group A of the dispersants useful in the practice of the present invention.

Specific examples of non-ionic surface active materials useful in the present invention are set forth in more detail below. The following structures illustrate non-ionic surface active materials useful in the present invention and are not exhaustive of the non-ionic surface active agents which may be found to be useful:

(1) Ethoxylated Alcohols (precursors of dispersants preferred for use in connection with polar carrier liquids):

$$R\text{-}O(CH_2CHYO)_nH;$$

R = saturated or unsaturated hydrocarbon having one to about 25 carbon atoms n = 1 to about 30; and Y = hydrogen or methyl. R may be a linear, branched, normal, secondary, tertiary, or iso structure but preferably R is a linear or branched alkyl or alkylene chain with 2–25 carbons or an alkylated aromatic group. More preferably, R is an alkyl chain with 4–15 carbons, n = 2–10 and Y is hydrogen.

(2) Ethoxylated alkyl phenols:

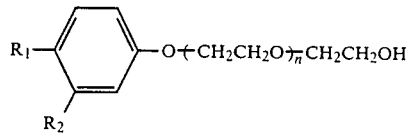

Usually, $R_1$ = tertiary $C_8$, or $C_9$;
$R_2$ = H or $C_8$ or $C_9$;
n = 1 to about 19;
Ordinarily $R_2$ is preferably H.

(3) Ethoxylated Fatty Acids:

$$R-\overset{O}{\overset{\|}{C}}-O(CH_2CH_2O)_nCH_2CH_2OH;$$

R=$C_{11}$ to about $C_{17}$, representing the alkyl group of lauric, myristic, palmitic, oleic, stearic, or isostearic acid.

n=1 to about 19;

(4) Ethoxylated Amides:

$$R_1-\overset{O}{\overset{\|}{C}}-\overset{R_2}{\overset{|}{N}}(CH_2CH_2O)_nCH_2CH_2OH;$$

$$R_1-\overset{O}{\overset{\|}{C}}-$$

is derived from a fatty acid such as lauric, myristic, palmitic, oleic, stearic, or isostearic acid;

$R_2=CH_3$ or $(CH_2CH_2O)_nCH_2CH_2OH$ and is preferably $CH_3$; and n=0 to about 29.

(5) Ethoxylated Amines:

$$R_1-\overset{R_2}{\overset{|}{N}}(CH_2CH_2O)_nCH_2CH_2OH;$$

$R_1$ can be an alkyl group with from about 4 to about 25 carbon atoms;

$R_2$ can be an alkyl group with from about 4 to about 25 carbon atoms or $R_2$ can be $-CH_3$ or $(CH_2CH_2O)_nCH_2CH_2OH$;

n=1 to about 29.

(6) Ethylene oxide/propylene oxide block polymers:

$$CH_3-\underset{CH_3}{\overset{H}{C}}-O(CH_2\underset{H}{\overset{CH_3}{C}}-O)_m(CH_2CH_2O)_nH$$

(Propylene oxide) (Ethylene oxide)

m and n are greater than 1.

Of course, when the foregoing precursors of A are part of an A-X-B dispersant compound of the present invention, their structure will be the same as that identified above except that the H of the terminal OH portion of the precursor will not be present and the X group will be linked to the oxygen of the terminal OH portion of the A group precursor. For instance, when A is derived from ethoxylated alcohols, the formula for A will be $R-O(CH_2CHYO)-$ Non-ionic surface active agents which are commercially available and may be useful as a precursor of A are described in "McCutcheons Annual, 1987, Emulsifiers and Detergents", North American and International Edition, MC Publishing Company, Glen Rock, N. J., U.S.A., the disclosure of which is incorporated herein by reference.

Dispersants formed in accordance with the present invention are most compatible with and are readily dissolved by polar liquid ester carrier liquids. The most preferred materials for use with polar liquid ester carrier liquids are ethoxylated alcohols identified above.

The structure of the X group which connects the oil soluble group with the carboxyl may be selected for convenience in dispersant synthesis or to enhance physical or chemical characteristics of the dispersant. In general, for convenience in dispersant synthesis, the precursor of the connecting group is selected so that by chemical reaction of the A group precursor with the X group precursor, the dispersant with the general structure A-X-B is formed directly.

Structures of X which may be useful in the present invention are illustrated by the following formulae:

$$-\overset{O}{\overset{\|}{C}}-(CH_2)_p- \quad p = 1\text{-}8;$$

$$\text{or } -(CH_2)_q- \quad q = 2\text{-}8;$$

or

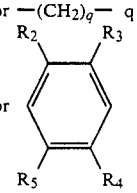

wherein $R_2$, $R_3$, $R_4$ and $R_5$ can be the same or different and may be hydrogen, alkyl groups with 1 to 25 carbons, halogen or additional A groups with A being any of the A group substituents described in the foregoing paragraphs.

The direct formation of an A-X-B dispersant of the present invention is illustrated by reaction of "DeSonic 6T", which is a mixture of compounds produced by reacting tridecyl alcohol with six moles of ethylene oxide (available from DeSoto Inc.), with a stoichiometric amount of succinic anhydride, produced directly a dispersant of the present invention with the general structure given below:

$$RO(CH_2CH_2O)_n\overset{O}{\overset{\|}{C}}CH_2CH_2\overset{O}{\overset{\|}{C}}OH.$$

The X group in the above formula is $$-\overset{O}{\overset{\|}{C}}CH_2CH_2-,$$

and the B group is COOH. When the A group derives from "DeSonic 6T", R is a linear $C_{13}$ alkyl group and n has an average value of six.

Other chemicals, particularly glutaric anhydride, can be used in place of succinic anhydride.

Oxidative stability of dispersants for magnetic colloids is a physical characteristic that can be improved by careful selection of the X group. Oxidative degradation of the dispersant results in gellation of the colloid.

For example, when "ferrofluids" using acid phosphoric acid esters of long chain alcohols as dispersants are subjected to temperatures in excess of about 100° C., particularly 150° C., the viscosity increases to unacceptable levels, ultimately resulting in the formation of a gel. Gel formation at 150° C. occurs much more rapidly when the "ferrofluid" is heated in air, compared with heating it under nitrogen. It is known that acid phosphoric acid esters of long chain alcohols undergo thermal decomposition at an appreciable rate at 150° C. This thermal decomposition of the acid phosphoric acid esters is the principal cause of gel formation when it is heated under nitrogen. Oxidative decomposition of the acid phosphoric acid ester in addition to the thermal decomposition is the cause of the more rapid formation of the gel when the "ferrofluid" is heated in air. It is believed that oxidative attack on the dispersant occurs at the tail portion of the dispersant closest to the magnetite, which is known to be an oxidation catalyst.

In the present invention, oxidative decomposition of dispersant "tail", (the A group) is diminished by using an oxidatively stable X group that increases the distance between the A group and the magnetite surface.

To provide enhanced oxidative stability in the superparamagnetic colloid, the X group can be an aromatic or a substituted aromatic substituent. In an embodiment with an aromatic X group, up to five A groups can be included in the dispersant, the structure of which is illustrated below:

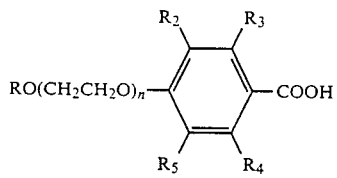

where the A group is $RO(CH_2CH_2O)_n$, the X group is the aromatic group, and the B group is COOH. R may be a linear or branched alkyl or alkylene chain with 2–25 carbons or an alkylated aromatic group and n is at least 1. $R_2$, $R_3$, $R_4$ and $R_5$, which may be the same or different, are hydrogen, alkyl groups with 1–25 carbons, halogen or additional $RO(CH_2CH_2O)_n$ groups.

A-X-B dispersants wherein X is aromatic may also be illustrated by the following formula:

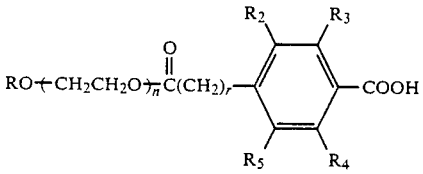

where the A group is $RO(CH_2CH_2O)_n$. the X group is:

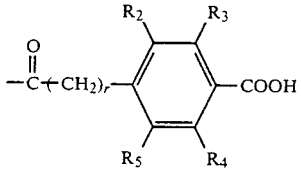

r is at least 1 and the B group is COOH. R again may be linear or branched alkyl or alkylene chain with 2–25 carbons or an alkylated aromatic group and n is at least 1. Preferably R is an alkyl chain with 4–15 carbons. As explained above, $R_2$, $R_3$, $R_4$, and $R_5$ may be the same or different and may be hydrogen, alkyl groups with 1–25 carbons, halogen or additional

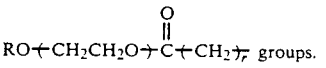

groups.

The X group may also be a halogenated aliphatic chain which may improve the oxidative stability of the dispersant. Fluorine is the preferred halogen and the length of the chain is preferably $C_2$–$C_{12}$. Of course, aromatic X groups may also be perfluorinated at $R_2$, $R_3$, $R_4$ and $R_5$.

Commercially available ether carboxylic acids, such as those produced by Chemische Fabrik CHEM-Y GmbH under the general name "Akypo" are also useful dispersants for the practice of our invention. The general formula of "Akypo" is believed to be illustrated by the following formula:

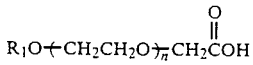

where the A group is $R_1O(CH_2CH_2O)_n$, the X group is $CH_2$, and the B group is COOH. $R_1$ is believed to be an alkyl group. Other ether carboxylic acids in which the $-(CH_2)_n-$group, corresponding to the X group of the dispersants useful in the practice of our invention, contains up to 8 or more carbon atoms, can be readily prepared by synthetic procedures well known to those skilled in the art.

In general, an alcohol reacted with six moles of ethylene oxide per mole of alcohol will be a mixture in which the alcohol will have combined with from about three to about nine ethylene oxide units. The major portion of the mixture consists of alcohol which has reacted with six ethylene oxide units. When these mixtures are reacted with an X group precursor, A-X-B dispersants with different molecular lengths are formed. These materials, attached to magnetite, will produce an irregularity in the coating which will inhibit association of the A groups with one another, a phenomenon sometimes referred to as "crystallization".

Carrier liquids useful in the practice of our invention are those liquids which do not form a superparamagnetic liquid with oleic acid coated magnetic particles. This requirement eliminates most non-polar low molecular weight oils such as kerosene or xylene. The carrier liquid may be a polar or a non-polar liquid and may be a high molecular weight material. Non-polar liquid hydrocarbons which may be useful as carrier liquids in the practice of our invention include, but are not limited to, synthetic or natural lubricating oil base stocks such as the alpha olefin oligomers and the 100-, 150-, 500-, and 600- neutral base oils. These materials are believed to be available commercially from Mobil Oil Company. Polar organic liquids useful in the present invention include esters, ketones, ethers, alcohols and water.

The carrier liquid must also be a thermodynamically good solvent for A. The solvent characteristics of particular carrier liquids will be determined largely by experience. Whether or not a particular carrier liquid will be a thermodynamically good solvent for A may also be predicted in accordance with principles discussed in "Dispersion Polymerization in Organic Media", K. E. J. Barrett, Editor, John Wiley & Sons, printed in Great Britain by J. W. Arrowsmith, Ltd. (1975) pages 50–51, the disclosure of which is incorporated herein by reference.

When the carrier liquid is a non-polar liquid hydrocarbon oil, the oil soluble group A is preferably a residue from a linear or branched, saturated or unsaturated, alcohol with from 2 to 25 carbon atoms, a fatty alcohol such as oleyl alcohol, or an alkylated aromatic compound.

Polar carrier liquids useful in the present invention are preferably polar esters which include, but are not limited to, those formed from organic acids and monohydric alcohols. Organic acids which may be used include monobasic organic acids such as acetic, benzoic, caproic, caprylic, capric, lauric, myristic, palmitic, oleic, stearic, and isostearic acids, dibasic organic acids such as adipic, azeleic, dimer, suberic, succinic, ortho-, meta-, and terephthalic acids, tribasic acids such as citric, trimer, and trimellitic acids, and tetrabasic acids as pyromellitic acid. The alcohols that may be used to prepare these esters include, but are not limited to, monohydric alcohols with from one to about 25 carbon atoms and include normal, secondary, tertiary, and isostructures, they may be saturated or unsaturated, linear or branched, and may be ethoxylated and/or propoxylated. They may include alcohols produced as a result of the oxo- or Ziegler-process. The esters may be prepared from a single alcohol or a mixture of two or more alcohols.

Esters useful in the present invention may also be prepared from polyhydric alcohols and monobasic organic acids. Polyhydric alcohols which can be used include but are not limited to ethylene glycol, propylene glycol, 1,3-propanediol, butylene glycol, 1,4-butanediol, glycerine, diethylene glycol, triethylene glycol, dipropylene glycol, tripropylene glycol, pentaerythritol, and trimethylolpropane. The esters may be prepared from a single monobasic organic acid or from a mixture of two or more monobasic acids.

Preferred polar liquids are trimethylolpropane mixed alkanoic acid triesters, mixed alkyl trimellitate triester, dialkyl sebacate and alkyl oleate. Trimethylolpropane mixed alkanoic acid triester is the most preferred carrier liquid, particularly with dispersants derived from ethoxylated alcohols.

Ketones which are useful as carrier liquids in the practice of our invention include but are not limited to acetone, methyl ethyl ketone, methyl isobutyl ketone, cyclopentanone, and cyclohexanone.

Ethers which are useful as carrier liquids in the practice of our invention include but are not limited to simple ethers such as diethyl ether, diethylene glycol dimethyl ether, diethylene glycol dibutyl ether, and cyclic ethers such as tetrahydrofuran and dioxane.

Alcohols which are themselves useful as carrier liquids in the practice of our invention include, but are not limited to, those listed above as useful for the preparation of esters used as carrier liquids in the practice of the present invention.

A simple test can be used to determine if a carrier liquid is useful in the practice of our invention. A quantity of about 50 ml of superparamagnetic liquid with a saturation magnetization of about 200 gauss consisting of fatty acid coated magnetite, preferably oleic acid coated magnetite, in hexane (see Procedure for Preparing Superparamagnetic Liquid Consisting of Fatty Acid Coated Magnetite) is mixed with about 50 ml of the liquid to be used as a carrier liquid in the practice of our invention and placed in a 250 ml beaker. The mixture is stirred and heated in a stream of air to evaporate the hexane and the beaker is placed over a samarium-cobalt magnet (cylindrical, diameter 25 mm and height 10 mm) and placed in a 65° C. oven for 24 hours. After cooling, the liquid is poured off from the residue on the bottom of the beaker while the magnet is held in place under the beaker. If substantially all of the coated magnetite remains at the bottom of the beaker, the carrier liquid is likely to be useful in the practice of our invention since it did not form a stable superparamagnetic liquid with the fatty acid coated magnetite.

In practicing the present invention, magnetic particles may be stably suspended in the carrier liquid when they are coated only with dispersants of the present invention. It is often preferable, however, to coat the magnetic particles with a $C_{18}$ monocarboxylic acid, such as oleic, isostearic, linoleic or linolenic acids, preferably oleic acid, peptize the fatty acid coated particles into a low molecular weight hydrocarbon, and subsequently coat the particles with dispersants of the present invention. The preliminary coating with oleic acid followed by allowing the coated magnetite to peptize into a low molecular weight hydrocarbon, rapidly and conveniently separates the magnetite from water and by-product ammonium salts which otherwise must be eliminated by tedious multiple washings with water. The preliminary coating with a $C_{18}$ carboxylic acid may be accomplished in accordance with the following procedure.

PROCEDURE FOR PREPARING SUPERPARAMAGNETIC LIQUID CONSISTING OF MAGNETITE COATED WITH A $C_{18}$ MONOCARBOXYLIC ACID

In a 1000 ml beaker was placed ferric chloride hexahydrate (1.93 mol, 521.7 g, from Merck) and water to make about 600 ml. This mixture was heated until all solids were dissolved. To the resultant solution was added ferrous sulphate heptahydrate (1.0 mol, 278 g) and water to make about 900 ml and this mixture was stirred until all solids were dissolved. This solution was allowed to cool to about 25° C. during which time a 3 liter (1) beaker equipped with a mechanical stirrer was prepared with 25% wt ammonium hydroxide solution (750 ml) and water (250 ml). To this stirred ammonium hydroxide solution was added the above prepared iron salt solution during which addition the temperature of the mixture rose to about 60° C. as a result of released heat of crystallization of the magnetite. Stirring was continued for about 20 minutes and then oleic acid (0.16 mol, 44.6 g) was added to the magnetite slurry was continued for another 20 minutes. To this slurry was added a low molecular weight hydrocarbon (150 ml, Shellsol T produced by Shell Oil Co.) and the mixture was stirred well and then allowed to separate. The resulting black colored organic phase was siphoned out into a 1 liter stainless steel beaker using a peristaltic pump. A second portion of Shellsol T was added to the aqueous magnetite slurry and treated the same was as the first portion of Shellsol T. The combined organic phases were heated in the stainless steel beaker to 130° C. to get rid of any trace of water and then allowed to cool over a strong magnet. The cold liquid was subsequently filtered through a paperfilter (Munktell no. 3) while keeping the magnet in place on the bottom of the beaker while pouring the liquid into the filter funnel. To get most of the liquid out of the beaker some Shellsol T was added to the residue and allowed to mix without any stirring and then filtered as above. The resultant product is the superparamagnetic liquid in a low molecular weight hydrocarbon. Its content of magnetite is given by its saturation magnetization value.

The saturation magnetization value of the stable superparamagnetic liquid was determined by the following procedure.

A sample of superparamagnetic liquid was taken up in a capillary glass tube (6.6 ul Minicaps #900.11.66, sold by TG-Gruppen) by capillary force to a height of at least 15 mm, typically 25 mm, and the end of this capillary tube was subsequently sealed by dipping it into a melt of polyethylene or similar polymer or wax. This sample was then put in a magnetic susceptibility balance (produced by Johnson Matthey AB). The instrument reading was noted and recalculated by multiplying with a constant to give the saturation magnetization value. This constant was calculated by, using the procedure above, measuring several superparamagnetic liquids whose saturation magnetization values were accurately known from vibrating reed magnetometer measurements.

Dispersants of the present invention have been prepared in accordance with the present specification and particularly Example 1 below. Structures of dispersants formed in accordance with the present invention are described in Table 1. The dispersants listed in Table 1 were prepared by the method described in Example 1. Table 2 summarizes tests showing the utility of various dispersants in dioctyl phthalate carrier liquid as established by tests described in Example 4. Data showing the utility of the A-X-B dispersants of the present invention in "Priolube 3970" (produced by Unichema BV) tested in accordance with Example 5 is summarized in Table 3.

EXAMPLE 1

PREPARATION OF A-X-B DISPERSANTS

In a 500 ml Erlenmeyer flask was placed 0.2 mol of the A group precursor (52.8 g of "DeSonic 6T" (tridecanol reacted with 6 moles of ethylene oxide, supplied by DeSoto Inc.)) and 0.2 mol of the X-B group precursor (20 g of succinic anhydride) along with 200 ml of xylene and 5 drops of pyridine. The mixture was agitated gently while it was heated to 150° C. on a hot plate and the clear solution was held at this temperature for 2 hours. The solution was allowed to cool to room temperature before it was diluted with additional xylene to a final volume of 500 ml. The solution was then 0.4 molar of an A-X-B dispersant in xylene. This dispersant is identified as dispersant number 2 in Table 1.

The procedure described in Example 1 was used for the preparation of the A-X-B dispersants whose composition are described in Table 1.

TABLE 1

Dispersants with the general structure: $RO(CH_2CHYO)_n(CO)(CH_2)_pCOOH$ When succinic anhydride is the X-B group precursor, R will be an alkyl group, p will be 2 while glutaric anhydride will give p = 3. Nos. 23 and 24 have Y = hydrogen and methyl while the others have Y = hydrogen.

| Dispersant No. | Trade name of A group precursor | Supplier | No. of C atoms in R | Number of EO units, n | X-B group precursor |
|---|---|---|---|---|---|
| 1 | DeSonic DA-4 | DeSoto Inc. | 10 | 4 | Succinic anhydride |
| 2 | DeSonic 6T | DeSoto Inc. | 13 | 6 | Succinic anhydride |
| 3 | DeSonic DA-6 | DeSoto Inc. | 10 | 6 | Succinic anhydride |
| 4 | Alfonic 1012-60 | Vista Chem. Co. | 10–12 | 5.7 | Succinic anhydride |
| 5 | Alfonic 1412-60 | Vista Chem. Co. | 10–14 | 7 | Succinic anhydride |
| 6 | Trycol 5967 | Emery Industries | 12 | 12 | Succinic anhydride |
| 7 | Trycol 5963 | Emery Industries | 12 | 8 | Succinic anhydride |
| 8 | Trycol 5941 | Emery Industries | 13 | 9 | Succinic anhydride |
| 9 | Trycol 5943 | Emery Industries | 13 | 12 | Succinic anhydride |
| 10 | Neodol 23-6.5 | Shell Chem. Co. | 12–13 | 6–7 | Succinic anhydride |
| 11 | Neodol 25-12 | Shell Chem. Co. | 12–15 | 12 | Succinic anhydride |
| 12 | Neodol 91-8 | Shell Chem. Co. | 9–11 | 8 | Succinic anhydride |
| 13 | Butyl carbitol | Aldrich Chem. Co. | 4 | 2 | Succinic anhydride |
| 14 | Butyl cellosolve | Aldrich Chem. Co. | 4 | 1 | Succinic anhydride |
| 15 | Ethyl carbitol | Aldrich Chem. Co. | 2 | 2 | Succinic anhydride |
| 16 | Ethyl cellosolve | Aldrich Chem. Co. | 2 | 1 | Succinic anhydride |
| 17 | Brij 30 | ICI Specialty Chem. | 12 | 4 | Succinic anhydride |
| 18 | Brij 52 | ICI Specialty Chem. | 16 | 2 | Succinic anhydride |
| 19 | Brij 92 | ICI Specialty Chem. | 18 | 2 | Succinic anhydride |
| 20 | Genapol X-030 | Hoechst AG | iso 13 | 3 | Succinic anhydride |
| 21 | Genapol X-050 | Hoechst AG | iso 13 | 5 | Succinic anhydride |
| 22 | Genapol X-060 | Hoechst AG | iso 13 | 6 | Succinic anhydride |
| 23 | Tergitol MinFoam 1X | Union Carbide Corp. | 12–14 | Note 1 | Succinic anhydride |
| 24 | Tergitol MinFoam 2X | Union Carbide Corp. | 13–14 | Note 1 | Succinic anhydride |
| 25 | Neodol 25-12 | Shell Chem. Co. | 12–15 | 12 | Glutaric anhydride |
| 26 | DeSonic DA-4 | DeSoto Inc. | 10 | 4 | Glutaric anhydride |
| 27 | Berol 07 | Berol Kemi AB | 16–18 | 18 | Succinic anhydride |
| 28 | Tergitol TMN-3 | Union Carbide Corp. | 12 Note 2 | 3 | Succinic anhydride |

Note 1
These are mixture of ethylene oxide and propylene oxide.
Note 2
TMN stands for trimethylnonyl.

EXAMPLE 2

TITRATION OF A-X-B DISPERSANTS

Exactly 4.00 ml of the 0.4 molar xylene solution of the A-X-B dispersant number 2, Table 1, prepared in accordance with the procedure of Example 1, was placed in a 50 ml beaker along with 10 ml of ethanol and 10 ml of water. The mixture was stirred vigorously and titrated with 0.1 molar sodium hydroxide, recording the pH of the mixture after each addtition of sodium hydroxide. The titration curve is shown in FIG. 1.

EXAMPLE 3

TITRATION OF DEXTROL OC-70, AN ACID PHOSPHORIC ACID ESTER

Exactly 2.00 ml of a Dextrol OC-70 solution in xylene (200 g Dextrol OC-70 in 500 ml of xylene) was placed in a 50 ml beaker along with 10 ml of ethanol and 10 ml of water. The mixture was stirred vigorously and titrated with 0.1 molar sodium hydroxide, recording the pH of the mixture after each addition of sodium hydroxide. The titration curves of Dextrol OC-70 acid phosphoric acid ester dispersant and dispersant number 2 of Table 1 are shown in FIG. 1. The calculated pKa values are 2.6 for the acid phosphoric acid ester dispersant and 6.7 for dispersant number 2 of Table 1.

EXAMPLE 4

EVALUATION OF A-X-B DISPERSANTS IN DIOCTYL PHTHALATE CARRIER LIQUID

The following general procedure was utilized to evaluate certain A-X-B dispersants and the results are summarized in Table 2.

A total of 23 g of oleic acid coated magnetite was allowed to peptize into approximately 200 ml of xylene and 80 ml of the 0.4 molar A-X-B dispersant solution prepared according to the procedure of Example 1 was added with stirring. The mixture was heated to about 110° C. in a stream of air to evaporate the xylene. The residue was cooled to about 30° C. and washed with a minimum of three consecutive 200 ml portion of acetone, each time collecting the magnetite particles on the bottom of the beaker over a magnet. Acetone washing was continued until the acetone extracts were clear and colorless. This process served to remove any excess A-X-B dispersant as well as any particles coated by the dispersant which may be dispersable in acetone.

A quantity of about 100 ml of ethyl acetate was added to the washed particles and they were heated to evaporate acetone. A volume of 50 ml of the carrier liquid was added to the ethyl acetate slurry and the mixture was heated to 110° C. in a stream of air to evaporate the ethyl acetate. The resulting superparamagnetic liquid was placed in a beaker over a magnet in a 65° C. oven for 24 hours, then filtered away from the particles too large to be stabilized by the dispersant and which were attracted to and held on the bottom of the beaker by the magnet.

TABLE 2

EVALUATION OF DISPERSANTS IN DIOCTYL PHTHALATE

| Dispersant No. (from Table 1) | Dispersed magnetite in acetone | Sat. magnetization value (gauss) of superparamagnetic liquid |
|---|---|---|
| 16 | no | no colloid formed |
| 14 | no | no colloid formed |
| 15 | no | no colloid formed |
| 13 | no | 193 |
| 1 | no | 248 |
| 4 | no | 230 |
| 2 | no | 242 |
| 10 | no | 236 |
| 9 | yes | 180 (excess. disp.) |
| 6 | yes | gel (excess. disp.) |
| 11 | yes | gel (excess. disp.) |
| 5 | no | 243 |
| 7 | no | 263 |
| 3 | no | 214 |
| 8 | no | 212 |
| 12 | no | 230 |
| 27 | yes | gel |
| 25 | yes | gel |

EXAMPLE 5

EVALUATION OF A-X-B DISPERSANTS IN "PRIOLUBE 3970" CARRIER LIQUID

This general procedure was utilized to evaluate certain A-X-B dispersants and the materials utilized as well as the results are summarized in Table 3.

A total of 100 ml of a 200 gauss superparamagnetic liquid consisting of oleic acid coated magnetic particles dispersed in Shellsol T prepared according to the procedure given in the Procedure For Preparing Superparamagnetic Liquid Consisting of Fatty Acid Coated Magnetite, was placed in a 400 ml beaker and about 100 ml of acetone was added to cause flocculation of the colloid. The magnetite particles were collected on the bottom of the beaker and kept thereby placing a strong magnet under the beaker and they were washed with an additional volume of 200 ml of acetone. To the residue was added about 200 ml of xylene and 80 ml of the 0.4 molar A-X-B dispersant solution prepared according to the procedure of Example 1. The mixture was heated at about 110° C. in a stream of air to evaporate the xylene. The residue was colled to about 30° C. and washed with a minimum of three consectutive 200 ml portions of acetone, each time collecting the magnetite particles on the bottom of the beaker over a magnet. Acetone washing was continued until the acetone extracts were clear and colorless. This process served to remove any excess A-X-B dispersant as well as any particles coated by the dispersant which may be dispersable in acetone.

A quantity of about 100 ml of ethyl acetate was added to the washed particles and they were heated evaporate acetone. A volume of 50 ml of the carrier liquid was added to the ethyl acetate slurry and the mixture was heated to 110° C. in a stream of air to evaporate the ethyl acetate. The resulting superparamagnetic liquid was placed in a beaker over a magnet in a 65° oven for 24 hours, then filtered away from the particles too large to be stabilized by the dispersant and which were attracted to and held on the bottom of the beaker by the magnet.

TABLE 3

EVALUATION OF DISPERSANTS IN "PRIOLUBE 3970"

| Dispersant No. (from table 1) | Dispersed magnetite in acetone | Sat. magnetization value (gauss) of superparamagnetic liquid |
|---|---|---|
| 1 | no | 280 |
| 4 | no | 305 |
| 5 | no | 301 |
| 2 | no | 316 |
| 10 | no | 316 |
| 20 | no | 176 |
| 21 | no | 335 |
| 22 | no | 335 |
| 17 | no | 250 |
| 18 | no | 40 |
| 19 | no | 167 |
| 28 | no | 126 |
| 23 | yes (note 1) | 315 |
| 24 | yes (note 1) | 319 |
| 12 | no | gel |
| Akypo RLM 45 | no | 319 |
| Akypo RLM 100 | no | 320 |

Note 1. In these preparations the coated particles were washed with methanol to remove the excess dispersant.

TABLE 4

VISCOSITY OF SUPERPARAMAGNETIC LIQUIDS USING "PRIOLUBE 3970" CARRIER

| Dispersant No. (from table 1) | Sat. magnetization value (gauss) of superparamagnetic liquid | Viscosity at 25° C. in centipoise (cP) |
|---|---|---|
| 2 | 316 | 82.4 |
| 10 | 316 | 79.5 |
| 21 | 335 | 103.6 |
| 22 | 335 | 84.4 |

TABLE 5

EVALUATION OF SOME CARRIER LIQUIDS USEFUL IN THE PRACTICE OF THE INVENTION

| Carrier liquid | Supplier | Fatty acid test | Useful under this invention |
|---|---|---|---|
| Dioctyl phthalate | Malmsten & Bergwall | negative | yes |
| Dibutyl sebacate | Ciba-Geigy | negative | yes |
| Priolube 3970 | Unichema Chemie | negative | yes |

Comparison of the data in Tables 1 and 2 show that the number of ethylene oxide units in the A group may have a significant effect not only on the ability of the dispersant to form a stable superparamagnetic liquid with the carrier but also on the physical properties of the superparamagnetic liquid itself.

For example, dispersant 14 which was formed from butoxyethanol (one ethylene oxide unit) did not form a superparamagnetic liquid in dioctyl phthalate, whereas dispersant 13 which was formed from butoxyethoxyethanol (two ethylene oxide units) did. In general, dispersants in Table 1 with A groups containing from about two to about nine ethylene oxide units formed stable coolidal suspensions in dioctyl phthalate, but did not in acetone. Dispersants 6, 9, 11, and 27 form colloidal suspensions in acetone but form a thermally reversible gel in dioctyl phthalate at room temperature.

Although applicants do not wish to be bound by any particular theory or explanation, it is believed that the very long A groups of these dispersants are not well solvated by the carrier liquid and therefore tend to associate with other long A groups on other particles. These attractions are weak and thermally reversible, but are sufficient to immobilize the coated magnetite at lower temperatures and allow the formation of the gel. It may also be possible that the presence of the excess dispersant promoted the formation of the gel since it was not possible to remove excess dispersant by acetone washing as described by the procedure of Example 5.

The sensitivity of the interaction between the A group of the dispersant and the solvent is further illustrated by the data in Table 3 in which "Priolube 3970" (Unichema Chemic B.V.), a trimethylolpropane triester is used as the carrier for the superparamagnetic liquid.

Comparing the data in Table 3 with the data of Table 2 indicates that the solubility characteristics of "Priolube 3970" are substantially different from those of dioctyl phthalate. For example dispersant 12 with eight ethylene oxide units in the A group formed a gel in "Priolube 3970", while dispersant 7 with eight ethylene oxide units in the A group formed a stable superparamagnetic liquid in dioctyl phthalate.

The saturation magnetization values of Table 3 show that dispersant 2, 10, 21, or 22 would be useful as dispersants in "Priolube 3970". However, a choice of the most useful material should also include consideration of the viscosity of the superparamagnetic liquid as shown in Table 4.

These data show that either dispersant 10 or dispersant 22 would be a preferred dispersant. However, dispersant 10 contains an average of 6–7 ethylene oxide units, dangerously close to the average of eight ethylene oxide units of dispersant 12 which formed a gel. Therefore, dispersant 22 which has 6 ethylene oxide units is the most preferred material.

The selection of a dispersant for a particular carrier liquid requires consideration of a number of factors described and explained in the foregoing specification. The ensuing paragraphs provide additional information useful in designing a dispersant for a particular carrier liquid.

A suitable dispersant is one that produces an ideal stable colloid (the partciles undergo elastic collisions) and that produces low colloid viscosity at any specific magnetization value.

It is quite difficult to predict the performance properties of a particular dispersant in a particular carrier liquid. For example, although oleic acid will produce a colloidal suspension of magnetite in a light weight liquid hydrocarbon, such as xylene, it will fail to produce a colloidal suspension of magnetite in heavier liquid hydrocarbons such as 6 centistoke (cst) poly(alpha olefin) oil. In order, therefore, to select a dispersant which forms the best superparamagnetic liquid in a specific carrier liquid, considering stability of the colloidal suspension and viscosity of the colloid at any given value of saturation magnetization, i.e., the volume content of magnetic material, it is ordinarily necessary to test a variety of dispersants with similar but somewhat different structure.

With a subdomain size particle of magnetite, the length of the oil soluble portion of a dispersant acid, when dissolved in the carrier liquid, must be at least about 0.2 times the diameter of the magnetic particle in order to maintain the magnetic particle in stable suspension. If the length of the oil soluble portion of the dispersant when dissolved in the carrier is less than about 0.2 times the diameter of the magnetic particle, the particles can approach closely enough so that the attractive force between the particles will overcome the repulsive force produced by the dispersant and the particles will agglomerate.

The saturation magnetization value of the supermagnetic liquid is determined by the volume content of magnetic material in the superparamagnetic liquid. The viscosity of the superparamagnetic liquid is, if it is one which is or approaches being an ideal colloid, a function of carrier liquid viscoisity and the total disperse phase volume. The disperse phase volume is that of the magnetic material plus the phase volume taken up by the A groups stretched out form the surface of the magnetic material. Therefore, when the A groups are longer than required to provide stability to the dispersed magnetic particles, the total disperse phase volume and therefore the colloid viscosity will be greater than it needs to be.

It will be apparent to those skilled in the art that various modifications and variations can be made in the products and processes of the prevent invention without departing from the scope or spirit of the invention. Thus, it is intended that the present invention cover modifications and variations thereof provided they come within the scope of the appended claims and their equivalents.

I claim:

1. A superparamagnetic liquid comprising:

I. magnetic particles in stable colloidal suspension;

II. a dispersing agent of the formula A-X-B anchored to said magnetic particles wherein A is derived from a non-ionic surface active agent precursor having a terminal OH group, said precursor selected from the group consisting of ethoxylated or propoxylated alcohols, ethoxylated alkyl phenols, ethoxylated fatty acids, ethoxylated amides, ethoxylated amines and ethylene oxide/propylene oxide block polymers wherein the structure of A in said A-X-B dispersant is the same as said precursor except that H of the terminal OH portion of said precursor is not present and said X group is linked to the oxygen of the terminal OH portion of said precursor, B is an organic carboxylic acid group which anchors said dispersing agent to said magnetic particles, and X is a connecting group linking A to B wherein X comprises at least one carbon atom;

III. a carrier liquid which is a thermodynamically good solvent for A but which does not form a stable superparamagnetic liquid with magnetic particles coated only with oleic acid.

2. A superparamagnetic liquid according to claim 1, wherein:

A is $RO(CH_2CHYO)_n$, in which R is a linear or branched alkyl or alkylene chain with 2–25 carbons or an alkylated aromatic group;

n is at least 1 to 19; and

Y is hydrogen or methyl.

3. A superparamagnetic liquid according to claim 1 wherein A is:

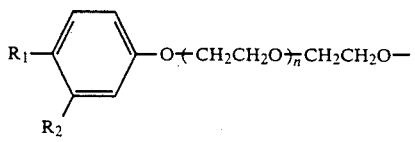

wherein, $R_1$=tertiary $C_8$, or $C_9$;

$R_2$=H or $C_8$ or $C_9$; and n=1 to 19.

4. A superparamagnetic liquid according to claim 1 wherein A is:

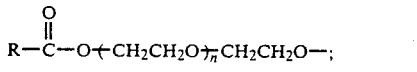

n=1 to 19;

R=$C_{11}$ to about $C_{17}$ carboxylic acid.

5. A superparamagnetic liquid as defined in claim 1 wherein A is:

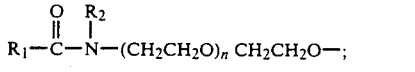

$R_1$ is a fatty acid;

n=0 to 29;

$R_2$=$CH_3$ or $(CH_2CH_2O)_n$ $CH_2CH_2OH$ and.

6. A superparamagnetic liquid as defined in claim 1 wherein A is:

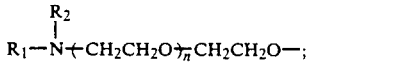

$R_1$ can be an alkyl group with from about 4 to about 25 carbon atoms;

$R_2$ can=$R_1$ or $R_2$ can be —$CH_3$ or $(CH_2CH_2O)_n$ $CH_2CH_2OH$;

n=1 to 29.

7. A superparamagnetic liquid as defined in claim 1 wherein A is:

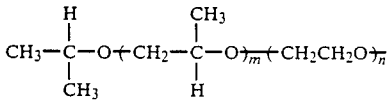

wherein m and n are greater than 1.

8. A superparamagnetic liquid according to claim 2, wherein X is:

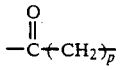

where p=1–8.

9. A superparamagnetic liquid according to claim 8, wherein p is 2 or 3.

10. A superparamagnetic liquid according to claim 2, wherein X is $(CH_2)_q$-where q=2–8.

11. A superparamagnetic liquid according to claim 2, wherein X is an aromatic or substituted aromatic group according to the formula:

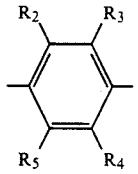

wherein $R_2$, $R_3$, $R_4$ and $R_5$ are the same or different and are hydrogen, alkyl groups with 1–25 carbons, halogen, or additional $R—O(CH_2CHYO)_n$ groups wherein Y is hydrogen or methyl and n is 1–19.

12. A superparamagnetic liquid according to claim 2, wherein X is a perfluorinated chain having 2–12 carbon atoms.

13. A superparamagnetic liquid according to claim 2, wherein R is an alkyl group with 4–15 carbons, Y is hydrogen and n=2–10 and wherein X is

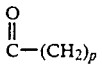

wherein p is 2 or 3.

14. A superparamagnetic liquid according to claim 1, wherein the carrier is an ester, ether, ketone, poly(alpha olefin) oil or a mineral oil.

15. A superparamagnetic liquid according to claim 2, wherein the carrier liquid is an ester, ether, ketone, poly(alpha olefin) oil or a mineral oil.

16. A superparamagnetic liquid according to claim 8, wherein the carrier liquid is a trimethylolpropane mixed alkanoic acid triester, a mixed alkyl trimellitate triester, a dialkyl sebacate, or an alkyl oleate.

17. A superparamagnetic liquid according to claim 13, wherein the carrier liquid is a trimethylolpropane mixed alkanoic acid triester, a mixed alkyl trimellitate triester, a dialkyl sebacate, or an alkyl oleate.

18. A superparamagnetic liquid according to claim 13, wherein said carrier liquid is a trimethylolpropane mixed alkanoic acid triester.

19. A superparamagnetic liquid according to claim 1, wherein the magnetic particles are coated with a fatty acid or mixtures of fatty acids that will peptize said magnetic particles into xylene.

20. A superparamagnetic liquid according to claim 13, wherein the magnetic particles are coated with a fatty acid or mixtures of fatty acids that will peptize said magnetic particles into xylene.

21. A superparamagnetic liquid according to claim 17, wherein the magnetic particles are coated with a fatty acid or mixtures of fatty acids that will peptize said magnetic particles into xylene.

22. A superparamagnetic liquid according to claim 19, wherein the fatty acid is oleic, linoleic, or isotearic acid.

23. A superparamagnetic liquid according to claim 21, wherein the fatty acid is oleic, linoleic, or isostearic acid.

24. A superparamagnetic liquid according to claim 15, wherein the magnetic particles are selected from the group consisting of magnetite, other ferrites, iron, nickel or cobalt metals and chromium dioxide.

25. A superparamagnetic liquid according to claim 18, wherein the magnetic particles are selected from the group consisting of magnetite, other ferrites, iron, nickel or cobalt metals and chromium dioxide.

26. A superparamagnetic liquid according to claim 5 wherein R is lauric, myristic, palmitic, oleic, stearic or isostearic acid.

27. A superparamagnetic liquid according to claim 5 wherein $R_1$ is lauric, myristic, palmitic, oleic, stearic or isotearic acid.

28. A superparamagnetic liquid according to claim 5 wherein $R_2$ is $CH_3$.

* * * * *